United States Patent [19]

Wageman

[11] Patent Number: 4,846,481

[45] Date of Patent: Jul. 11, 1989

[54] STRING ATTACHING DEVICE FOR ARROWS

[76] Inventor: Arthur R. Wageman, 1358 E. 56 St., Brooklyn, N.Y. 11234

[21] Appl. No.: 222,877

[22] Filed: Jul. 22, 1988

[51] Int. Cl.[4] ..... F41B 5/02

[52] U.S. Cl. ..... 273/416

[58] Field of Search ..... 273/416, 419, 420, 418; 43/6

[56] References Cited

U.S. PATENT DOCUMENTS

| | | | |
|---|---|---|---|
| 3,064,977 | 11/1962 | Zwickey | 273/419 |
| 3,339,292 | 9/1967 | Kuchlis | 434/302 |
| 3,565,435 | 2/1971 | Bear | 273/418 |
| 3,865,374 | 2/1975 | Troncoso, Jr. | 273/423 X |
| 4,268,038 | 5/1981 | Wierenga | 273/416 |
| 4,380,340 | 4/1983 | Simo | 273/416 |
| 4,463,953 | 8/1984 | Jordan | 273/418 |

*Primary Examiner*—Paul E. Shapiro

*Attorney, Agent, or Firm*—Henderson & Sturm

[57] ABSTRACT

A string attaching device (10) for securing a tracking string (103) to a portion of a hunting arrow (105); wherein the string attaching device (10) includes: a sleeve unit (11) that fits over the forward end of the arrow shaft (107); a capture unit (12) hingedly connected to the sleeve unit (11) and adapted to frictionally engage the tracking string (103); and, a collar unit (13) adapted to slidingly engage the sleeve unit (11) and increase the frictional engagement of the capture unit (12) relative to the tracking string (103).

12 Claims, 1 Drawing Sheet

STRING ATTACHING DEVICE FOR ARROWS

Technical Field

The present invention relates generally to the field of string tracking mechanisms for a bow and arrow, and more particularly to devices for securing a string to a portion of a hunting arrow.

BACKGROUND OF THE INVENTION

String tracking devices have become very popular recently among bowhunters in that the better string tracking devices insure that mortally wounded game can be retrieved even in the absence of a blood trail.

Briefly stated, the conventional design for a string mechanism involves a spool containing a quantity of very fine thread or string; wherein, the spool is mounted on the front of a bow and the free end of the string is attached to a hunting arrow. When the arrow strikes the game animal or bird, the string pays out of the spool as the wounded game flees from the area leaving a trail of string which extends from the fleeing game to the bowhunter. By following the string the bowhunter will be able to trace the path that the game traveled up to the point where it expired.

While string tracking mechanisms are a positive contribution to game conservation in that they enable mortally wounded game to be recovered, they also present problems for the bowhunter in that conventional arrows with their streamlined configurations are not designed to facilitate the attachment of the free end of a tracking string to any of the arrows external surfaces.

One of the prior art solutions to this problem has been to tie the string to the threaded stem of the broadhead so as to capture the string between the broadhead and the collar of the conventional threaded insert in the arrow shaft that allows different arrow points to be used with the shaft.

Another solution has been to capture a wire extension element between the broadhead and the insert collar; wherein, the trailing end of the wire element is formed into a loop, which projects outwardly from the arrow shaft and provides a surface to which the free end of the tracking string may be tied.

Not only does this later solution add unwanted weight to the arrow shaft causing the arrow to drop below its normal arc of trajectory; but, the protruding unbalanced projection of the wire element also drastically alters the aerodynamic profile of the arrow and imparts erratic characteristics to its flight.

As a consequence of the foregoing situation, it comes as somewhat of a surprise that to date no one has developed a low profile, lightweight, string attaching device for arrows that is quick, convenient and easy to use; yet, which also does not unduly alter the aerodynamic characteristics of an arrow upon which it is installed.

Needless to say, there has been a longstanding need among bowhunters for a device having the aforementioned characteristics, and the provision of such a device is the stated objective of this invention.

BRIEF SUMMARY OF THE INVENTION

Briefly stated, the string attaching device for arrows that forms the basis of the present invention comprises a sleeve unit having a capture unit and a movable collar unit; wherein, the sleeve unit is disposed intermediate the broadhead and the arrow shaft; and, wherein the capture unit is adapted to frictionally engage the free end of a tracking string against the side of the sleeve unit.

In addition, the sleeve unit is provided with a recessed portion that contains the capture unit; wherein, the recessed portion of the sleeve unit is dimensioned to receive the collar unit which is adapted to overlie the capture unit when the capture unit has captively engaged the tracking string against the side of the sleeve unit.

Furthermore, the string attaching device is fabricated from lightweight materials so as not to add a significant amount of weight to the arrow; and the device is further dimensioned and configured to provide a very low relatively uniform aerodynamic profile relative to the arrow shaft.

It should also be noted that the string attaching device of this invention obviates the need for the bowhunter to handle sharp broadheads while securing the string to the arrow shaft; and, the hunter does not have to thread or tie knots in the string to effect the operative engagement between the string and the arrow.

BRIEF DESCRIPTION OF THE DRAWINGS

These and other objects, advantages, and novel features of the invention will become apparent from the detailed description of the best mode for carrying out the preferred embodiment of the invention which follows; particularly when considered in conjunction with the accompanying drawings, wherein.

BEST MODE FOR CARRYING OUT THE INVENTION

Figure 1:
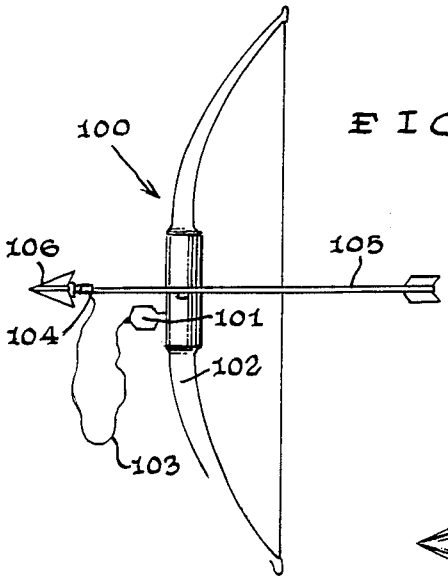
FIG. 1 is a perspective view of the string attaching device used in conjunction with a conventional string tracking apparatus.

As depicted in FIG. 1, a conventional string tracking arrangement is designated generally as (100) and comprises a spool (101) mounted on a bow (102) and containing a quantity of tracking string (103) having its free end (104) attached to a hunting arrow (105) equipped with a broadhead (106).

Figure 2:
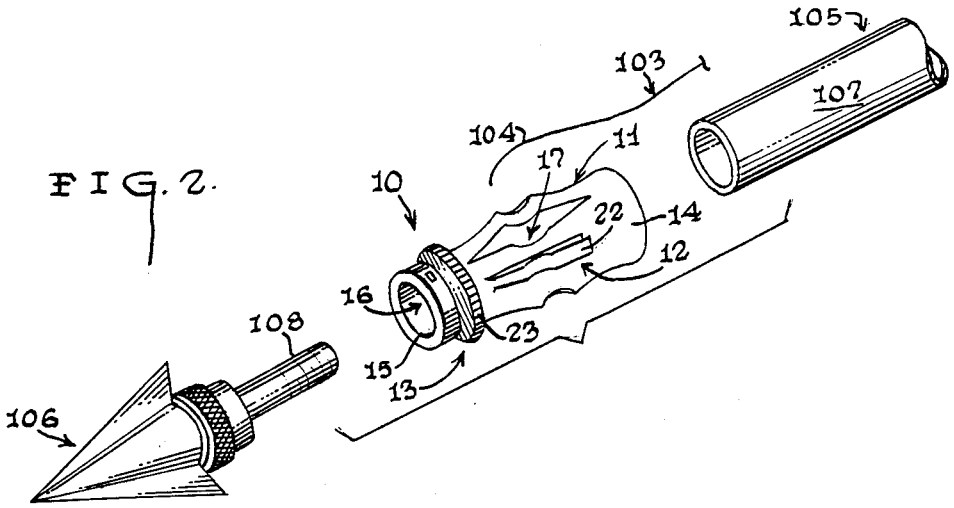
FIG. 2 is an exploded perspective view of the device and a conventional hunting arrow.

Turning now to FIG. 2 it can be seen that the string attaching device that forms the basis of the present invention is designated generally as (10); wherein, the string attaching device (10) is designed to be disposed intermediate the broadhead (106) and the shaft (107) of an arrow (105).

Figure 3:
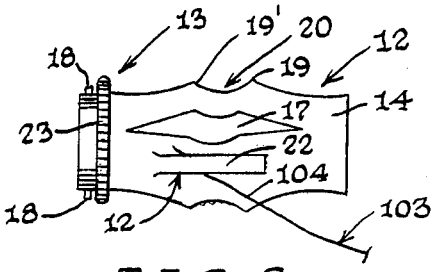
FIG. 3 is an isolated side plan view of the device.

As can best be seen by reference to FIG. 3, the string attaching device (10) comprises in general: a sleeve unit (11); a capture unit (12); and, a collar unit (13). These units will now be described in seriatim fashion. The sleeve unit (11) comprises a generally cylindrical flexible resilient sleeve member (14) having a shoulder portion (15) formed on its forward end. The shoulder portion (15) of the sleeve member (14) defines a central aperture (16) which is dimensioned to accommodate the passage of the threaded stem (108) of the broadhead (106); yet, prevent the passage of the shaft (107) of the arrow (105); such that the interior of the shoulder portion (15) of the sleeve member (14) will rest upon the forward end of the arrow shaft (107) in the assembled mode.

In addition, the sleeve member (14) is further provided with a plurality of elongated slits (17) disposed at spaced locations around its periphery; wherein, the slits (17) allow the ends of the sleeve member (14) to be compressed towards one another due to the flexible nature of the walls of the sleeve member (14).

As can also be seen by reference to FIGS. 3 and 4, the sleeve member (14) is further provided with a plurality of nipple elements (18) which are formed on the periphery of the sleeve member (14) adjacent the forward end; and, a pair of raised peripheral rib portions (19) disposed in a surrounding relationship relative to the plurality of slits (17); wherein, the raised rib portions (19) define a recess (20) whose purpose and function will be described in greater detail further on in the specification.

Figure 4:
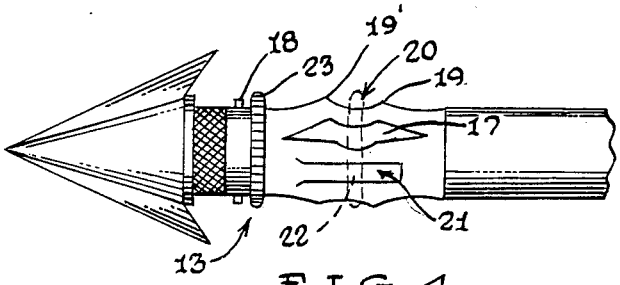
FIG. 4 is a side plan view of the device mounted on a hunting arrow.

As shown in FIGS. 2 thru 4, the capture unit (12) comprises at least one elongated capture member (21) hingedly connected to the sleeve member (14) proximate the location of the elongated slits (17).

In the preferred embodiment of the invention depicted in the drawings, the capture unit (12) comprises a plurality of capture members (21) disposed around the periphery of the sleeve member (14); wherein, each of the capture members (21) is formed by an elongated strip (22) cut from the walls of the sleeve member (14).

Turning now to FIGS. 3 and 4, it can be seen that the collar unit (13) comprises a resilient gasket member (23), such as an O-ring or the like; wherein, the gasket member (23) is dimensioned to be slidingly received on the periphery of the sleeve member (14); and, wherein the forward progress of the gasket member (23) is limited by the presence of the plurality of nipple elements (18) on the forward end of the sleeve member.

In the operative disposition of the string attaching device (10) depicted in FIG. 4, the device (10) is slipped over the forward end of the arrow shaft (107) and captively held in place when the threaded end (108) of the broadhead (106) engages the conventional arrow insert (not shown) disposed within the shaft (107). At this juncture the resilient gasket member (23) assumes the position depicted in solid lines proximate the front of the sleeve member (14); whereupon the free end (104) of the tracking string (103) is slipped under one of the elongated capture members (21) so that the string (103) is lightly held against the side of the sleeve member (13).

Once the string (103) is disposed underneath the capture member (21) and against the side of the sleeve member (14); the resilient gasket member (23) is rolled over the leading raised rib (19′) and into the recess (20) as shown in dashed lines to dramatically increase the frictional engagement of the string (103) by the capture member (21).

It should be appreciated that when it is desired to release the string (103) from the string attaching device; all that is required is to roll the gasket member (23) towards the broadhead (106) and over the leading raised rib (19′); whereupon, the string (103) may be disengaged from the capture member (21) by a simple tug.

It should also be appreciated that the foregoing arrangement allows all of the arrows in a hunting quiver to be equipped with string attaching devices (10) whereby the presence of these devices (10) will not interfere with the insertion and removal of the individual arrows from the quiver.

In addition, since in the preferred embodiment of this invention both the sleeve unit (11) and the integral capture unit (12) are intended to be fabricated from thin lightweight plastic and the collar unit (13) is intended to be fabricated from a lightweight elastomeric material such as rubber; the total weight added to a conventional hunting arrow will be minimal.

Having thereby described the subject matter of this invention, it should be apparent that many substitutions, modifications, and variations are possible in light of the above teachings. It is therefore to be understood that the invention as taught and described herein is only to be limited to the extent of the breadth and scope of the appended claims.

What is claimed is:

1. A string attaching device for attaching a tracking string to a hunting arrow having an arrow shaft equipped with a broadhead having a threaded stem; wherein, the string attaching device comprises:

a sleeve unit comprising a generally cylindrical sleeve member dimensioned to slide over the forward end of the shaft of a hunting arrow and having a shoulder portion formed on the forward end of the sleeve member defining a central aperture that is dimensioned to accommodate the threaded stem of the broadhead and prevent the passage of the arrow shaft;

a collar unit comprising a gasket member that is dimensioned to slidingly engage the periphery of said sleeve unit to frictionally engage a tracking string against the side of the generally cylindrical sleeve member; and, a plurality of nipple elements formed on the periphery of the forward end of the sleeve member; wherein, the nipple elements will limit the forward travel of the gasket member relative to the sleeve member.

2. The string attaching device as in claim 1 wherein the sleeve unit comprises:

a generally flexible resilient sleeve member.

3. The string attaching device as in claim 1 wherein the sleeve unit further comprises:

a plurality of elongated slits formed at spaced locations around the periphery of the sleeve member.

4. The string attaching device as in claim 3 wherein the sleeve unit further comprises:

a pair of raised rib portions formed on the periphery of the sleeve member and spaced from one another to define a recess that is dimensioned to accommodate the gasket member When the gasket member is brought into frictional engagement with the tracking string.

5. The string attaching device as in claim 1 further including:

a capture unit including at least one elongated capture member hingedly connected to said sleeve member; wherein the capture member is adapted to frictionally engage the tracking string against the side of the sleeve member.

6. A string attaching device for attaching a tracking string to a hunting arrow having an arrow shaft equipped with a broadhead having a threaded stem; wherein, the string attaching device comprises:

a sleeve unit comprising a generally cylindrical sleeve member dimensioned to slide over the forward end of the shaft of a hunting arrow and having a shoulder portion formed on the forward end of the sleeve member defining a central aperture that is dimensioned to accommodate the threaded stem of the broadhead and prevent the passage of the arrow shaft; and, a capture unit including at least one elongated capture member hingedly connected to said sleeve member; wherein the capture member is adapted to frictionally engage the tracking string against the side of the sleeve member.

7. The string attaching device as in claim 6 further comprising:

a collar unit comprising a gasket member that is dimensioned to slidingly engage the periphery of said sleeve unit to increase the frictional engagement between the capture unit and the tracking string.

8. The string attaching device as in claim 7 wherein the sleeve unit further comprises:

a plurality of nipple elements formed on the periphery of the forward end of the sleeve member; wherein, the nipple elements will limit the forward travel of the gasket member relative to the sleeve member.

9. The string attaching device as in claim 8 wherein the sleeve unit comprises:

a generally flexible resilient sleeve member.

10. The string attaching device as in claim 9 wherein the sleeve unit further comprises:

a plurality of elongated slits formed at spaced locations around the periphery of the sleeve member.

11. The string attaching device as in claim 10 wherein the sleeve unit further comprises:

a pair of raised rib portions formed on the periphery of the sleeve member and spaced from one another to define a recess that is dimensioned to accommodate the gasket member when the gasket member is brought into frictional engagement with the, tracking string.

12. The string attaching device as in claim 11 wherein the gasket member is dimensioned to overlie the elongated capture member to increase the frictional engagement between the capture member and the tracking string relative to the side of an arrow shaft.

* * * * *